US006575224B1

(12) United States Patent
Hetherington

(10) Patent No.: US 6,575,224 B1
(45) Date of Patent: Jun. 10, 2003

(54) APPARATUS AND METHOD FOR CONTROLLING THE FLOW OF MOLTEN METAL

(75) Inventor: Adrian Hetherington, Sheffield (GB)

(73) Assignee: Vai Industries (UK) Limited (GB)

( * ) Notice: Subject to any disclaimer, the term of this patent is extended or adjusted under 35 U.S.C. 154(b) by 0 days.

(21) Appl. No.: 09/743,969

(22) PCT Filed: Jul. 16, 1999

(86) PCT No.: PCT/GB99/02149

§ 371 (c)(1),
(2), (4) Date: Mar. 12, 2001

(87) PCT Pub. No.: WO00/03822

PCT Pub. Date: Jan. 27, 2000

(30) Foreign Application Priority Data

Jul. 17, 1998 (GB) ..... 9815535

(51) Int. Cl.[7] ..... B22D 11/18

(52) U.S. Cl. ..... 164/453; 164/488; 164/438; 222/594

(58) Field of Search ..... 164/453, 437, 164/438, 439, 440, 335, 336, 337, 488; 222/594, 595, 596

(56) References Cited

U.S. PATENT DOCUMENTS

| | | | | | |
|---|---|---|---|---|---|
| 2,223,062 | A | * | 11/1940 | Edgar, Jr. | 22/85 |
| 3,724,529 | A | * | 4/1973 | Chaulet et al. | 164/154 |
| 4,506,425 | A | * | 3/1985 | Hoyer et al. | 29/402.18 |
| 4,508,247 | A | * | 4/1985 | Mills et al. | 222/598 |
| 4,905,755 | A | * | 3/1990 | Lothmann | 164/453 |
| 4,953,761 | A | * | 9/1990 | Fishman et al. | 222/602 |
| 5,118,084 | A | * | 6/1992 | Paulus et al. | 266/236 |

FOREIGN PATENT DOCUMENTS

| | | | |
|---|---|---|---|
| DE | 395694 | | 5/1924 |
| DE | 2649483 | | 4/1978 |
| EP | 41051 | | 7/1984 |
| EP | 439681 | | 7/1995 |
| FR | 1442566 | | 10/1966 |
| JP | 58-41660 | * | 3/1983 |

OTHER PUBLICATIONS

SERT Company, MonoBloc, MQS Series Design.

* cited by examiner

*Primary Examiner*—M. Alexandra Elve
*Assistant Examiner*—Len Tran
(74) *Attorney, Agent, or Firm*—Madson & Metcalf

(57) ABSTRACT

An apparatus for controlling the flow of material, such as molten metal, from a container is disclosed. The apparatus includes a first closing element for the outlet from the container, a support system for the first element, an actuator system for moving the support system and first element, a fixed support frame for mounting the support system and first element, and a bearing system between the fixed support frame and the support system to facilitate movement of the support system relative to the fixed support frame. The bearing system comprises one or more contact surfaces between a component of the support framework and a component of the support system, at least one of the components providing a contacting surface capable of rotation.

23 Claims, 2 Drawing Sheets

APPARATUS AND METHOD FOR CONTROLLING THE FLOW OF MOLTEN METAL

This invention concerns improvements in and relating to handling molten materials, particularly, but not exclusively, in relation to controlling the flow of molten metal from a tundish.

Casting operations generally employ a tundish to act as a reservoir of molten metal between the ladle and the mould. The ladle is used to convey molten metal from a melting location to the casting location. The mould is used to control the profile of the solidifying metal during casting.

To control the flow of metal from a tundish it is necessary to block and open an outlet in the tundish, in a controlled manner. In general this is achieved using a stopper element in the molten metal which cooperates with the outlet to seal it, the stopper being supported by a stopper guide which is moved up and down using an actuator.

The stopper is frequently supported at a considerable distance away from the portion of the stopper guide moved by the actuator. As a consequence of this problems in supporting the stopper in the correct alignment and with reasonable levels of friction exist. Prior art systems are prone to jamming and/or friction levels which give rise to uneven movement of the stopper, or excessive clearance can lead to misalignment. These problems all give rise to poor control of the flow from the tundish, as well as increasing the mechanical loading on the actuator system.

The present invention aims to provide an improved stopper gear mechanism in which the stopper movement and positioning is controlled with great precision and the mechanical loads on the stopper gear and actuator are reduced.

According to a first aspect of the present invention we provide apparatus for controlling the flow of material, such as molten metal, from a container, the apparatus comprising a closing element for the outlet from the container, a support system for the first element, an actuator system for moving the support system and first element, a fixed support frame for mounting the support system and first element, and a bearing system between the fixed support framework and the support system to facilitate movement of the support system relative to the fixed support framework, wherein the bearing system comprises one or more contact surfaces between a component of the support framework and a component of the support system, at least one of the components providing a contacting surface capable of rotation.

Preferably the bearing system facilitates reciprocating movement of this support system relative to the fixed support framework. Reciprocating movement along a vertical axis is preferred in this regard.

Preferably the contact surface(s) provided by one of the support framework or support system is a flat surface(s) The flat surface(s) may be provided by the support framework, preferably one provided by the support system, more preferably by the support shaft of the support system and most preferably by a face of a square cross-section part of the support shaft.

The contact surface capable of rotation may be provided by the support system, or more preferably by the fixed support framework. Preferably the rotatable contacting surface is provided by a unit mounted on the fixed support framework.

Preferably the unit comprises a mount, such as a shaft, providing rotation facilitating retention of the rotatable contact surface and attached to the fixed support framework.

Preferably the rotation facilitating retention is provided by an axle engaging the element defining the rotatable contacting surface. Preferably the element is a cam or cam follower. The cam followers preferably have eccentric shafts.

Preferably at least two opposing contact surfaces between a component of the support framework and a component of the support system are provided. More preferably two sets of contact surfaces, in opposition to one another, between a component of the support framework and a component of support system are provided. Preferably the first set of opposing contact surfaces is offset by an angle of 90° relative to the second set of contact surfaces. Preferably the axis of rotation for the first and/or second set of contact surfaces are provided in a common plane, most preferably a horizontal plane, and ideally a plane perpendicular to the component of the support or support framework in question. Two or more such groups of contact surfaces may be provided. Preferably one such set of contact surfaces are provided on an upper portion of the support system and a second set is provided on a lower portion of the support system.

Preferably the molten metal flows from the container to a casting or moulding operation. Preferably the molten metal is supplied to the container by a ladle. The container is preferably a tundish.

Preferably the first closing element comprises a stopper rod. Preferably the stopper rod is provided on a substantial vertical axis within the container. Preferably the end of the stopper rod is configured to cooperate in a sealing manner with the outlet from the container.

Preferably the outlet from the container is provided in the base of the container. Preferably the mouth of the outlet cooperates with the profile of the end of the stopper rod to give closure. The outlet may have rounded edges, at its internal periphery.

Preferably the support system comprises a laterally extending, most preferably horizontally extending, element. The element may be a bar.

Preferably the support system comprises, or further comprises, a substantially vertically aligned support shaft. Preferably the support shaft is received in the bearing system. Preferably the support shaft provides a mounting for the laterally extending element.

The support system may include one or more portions rotatably mounted relative to one another. For instance a support shaft, received in the bearing system may be provided, two or more portions of the support shaft being adapted to rotate relative to one another. Rotation may be facilitated by bushes. Preferably rotation occurs about the longitudinal axis of the shaft.

The support shaft may comprise one or more portions providing a contact surface of the bearing system, longitudinally spaced from one another on the shaft, rotation movement of the portions relative to one another being facilitating.

The support system may comprise, or preferably further comprise, an element linking the support shaft to the actuator. A horizontally extending element connected to the bottom of the support shaft is preferred in this regard.

The actuator system may comprise a reciprocating mover, for instance an hydraulic piston. Preferably the actuator reciprocates along a substantially vertically aligned axis.

Preferably the fixed support framework mounts the support system, via the bearing system, on the container. Preferably the support system is provided with a mounting on the side of the container.

According to a second aspect of the invention we provide means for providing a controlled supply of molten metal, the means comprising a container, adapted to receive molten metal in use, the container having an outlet, the outlet cooperating with the closing element of a control apparatus of the first aspect of the present invention.

The second aspect of the invention may include any of the means, options, possibilities and components set out in the first aspect of the invention and/or elsewhere in this document.

According to a third aspect of the present invention we provide a method for controlling the flow of molten metal from a container, the method comprising the steps of providing a volume of molten metal in the container, moving an actuator from a first position to a second position, the change in position of the actuator moving a support system relative to a fixed support framework by rotating a contact surface in the bearing system between the support system and the fixed support framework, the contact surfaces of the bearing system being defined between a component of the support system and the component of the fixed support framework, the movement of the support system moving a closing element for the outlet from the container, movement of the closing element away from the outlet facilitating flow of molten metal out of the outlet, movement of the closing element into contact with the outlet from the container preventing the flow of molten metal from the container.

Preferably movement of the actuator downward moves the closing element downward. Preferably movement of the actuator upward causes movement of the closing element upward.

The components, options, features, possibilities and steps of this method may further include details, features and possibilities set out elsewhere in this document.

BRIEF DESCRIPTION OF THE DRAWINGS

Embodiments of the present invention will now be described, by way of example only, and with reference to the accompanying drawings in which.

Figure 1:
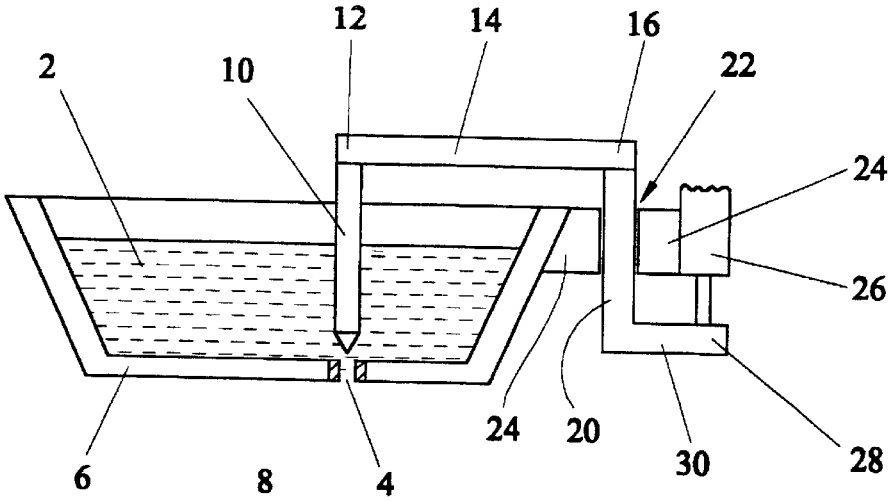
FIG. 1 illustrates a cross sectional view of a tundish and stopper gear mechanism.

The tundish and stopper gear mechanism illustrated in FIG. 1 is used to control the flow of molten metal 2 to a moulding stage, not shown, via an outlet 4 in the base of the tundish 6. The flow of metal 2 through the outlet 4 is controlled by the engagement of, or spacing between, the end 8 of the stopper element 10 and the outlet 4.

The stopper bar 10 is formed of refractory material and forms a consumable component of the stopper guide mechanism, as it is present in the molten material 2. The vertically arranged stopper bar 10 is supported on the end 12 of a horizontal support arm 14. The support arm 14 itself is mounted on the upper end 16 of a vertically provided support shaft 20.

The support shaft 20 is provided so as to slide within a bore 22 provided in the supporting framework 24 mounted on the tundish 6. The sliding engagement between the support shaft and the supporting system is affected by a series of slide plates, discussed in more detail below in relation to FIG. 2.

The position of the stopper 1C is controlled via an actuator 26 which acts on the end 28 of an element 30 connected to the support shaft 20. Extension of the actuator lowers the stopper end 8 into engagement with the outlet 4. Retraction of the actuator 26 lifts the stopper end 8 out of engagement with the outlet 4, thereby allowing flow of the molten material 2 out of the tundish 6.

The accurate positioning of the end 8 of the stopper 10 relative to the outlet 4 is critical in controlling the flow of molten metal 2. Inaccurate positioning gives an inaccurate control of the flow of molten metal. Erratic movement of the stopper 10 gives erratic variations in the flow of molten metal 2.

Figure 2:
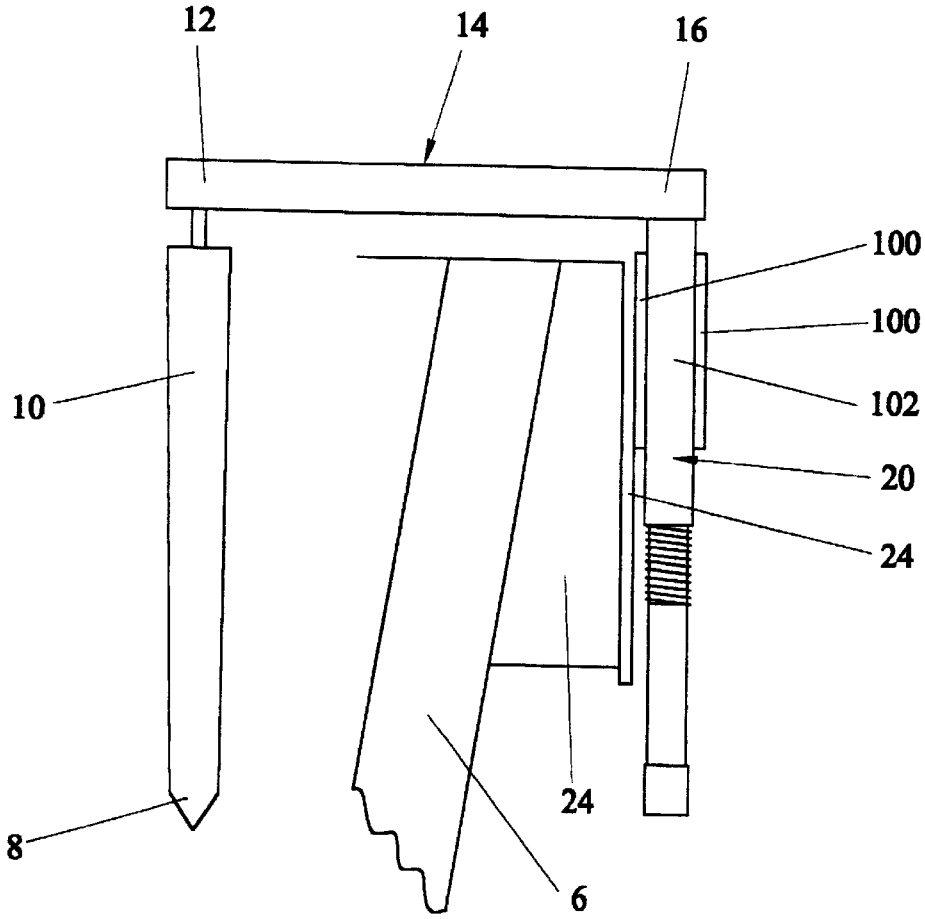
FIG. 2 illustrates a cross sectional view through a stopper gear mechanism.

When the sliding engagement between the support shaft 20 and the supporting framework 24 is provided using guide plates 100, see FIG. 2, then problems can occur. In this system, a square section 102 of the support shaft 20 is engaged on its four faces by the guide plates 100. The sliding surface which results has a relatively high level of friction and is also prone to jamming. Overcoming the high level of friction requires a significant load from the actuator, a loading which once the support shaft 20 starts moving can result in too great an effective outlet arising.

The use of plates 100, engaging on a square section 102 of shaft 20, also faces problems from misalignment due to movement in the components of the system. The supporting framework 24 is mounted on the tundish 6 and as a consequence is exposed to high temperatures. These temperatures vary, however, depending upon the level of molten material within the tundish 6, and as a consequence cain give rise to deformation in the supporting frame 24 and/or in the plates 100 themselves. Any such deformation can significantly increase the level of friction encountered in the sliding system and/or lead to misalignment to such an extent that the stopper mechanism jams. Either of these can give rise to problems in controlling molten metal discharge and give rise to general problems in the casting/moulding operation as a result.

Figure 3:
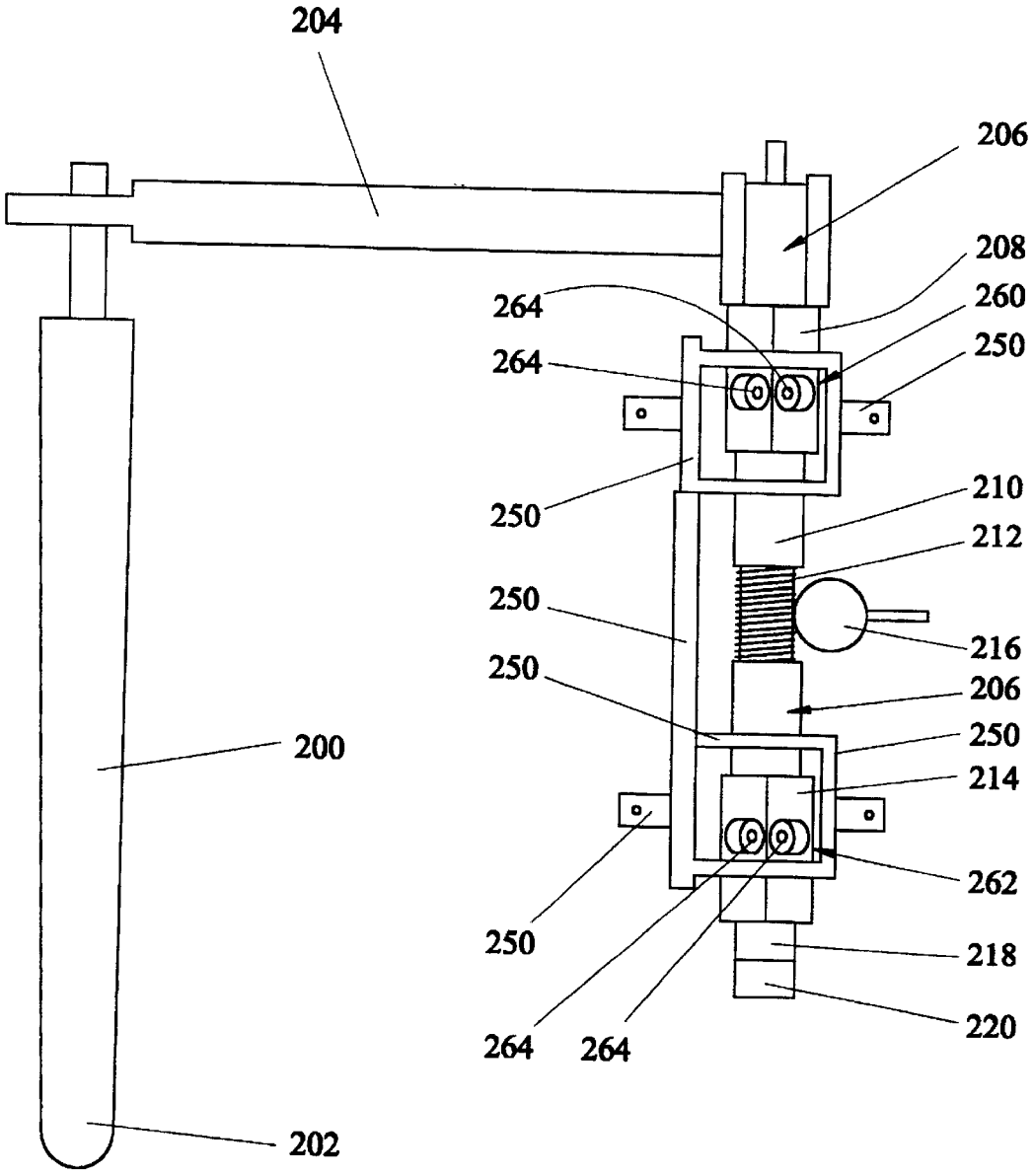
FIG. 3 illustrates a cross sectional view through a stopper gear mechanism according to a first embodiment of the present invention.

The system of the present invention is illustrated in one embodiment in FIG. 3. Once again a stopper rod 200 is provided. The stopper rod 200 has an end portion 202 configured to cooperate with the mouth of an outlet in the tundish in question. The stopper rod 200 is mounted on an horizontal arm 204 which in turn is mounted on a support shaft 206. The support shaft 206 comprises an upper square cross sectioned length 208, a circular cross sectioned length 210 which is provided with a circular rack portion 212 and a lower square cross-sectional length 214 mounted coaxially. The screw threaded portion 212 cooperates with a manual operating spur gear and lever 216 which is used to raise or lower the stopper manually, as required. The square cross section 214 is mounted on to support shaft 206 via bushes to allow rotation of 214 relative to shaft 206 about the longitudinal axis of shaft 206. This potential for rotation of the lower square cross section being able to rotate avoids another possible source of jamming. The bottom end 218 of the support shaft 208 is connected to an horizontal arm 220 which in turn is connected to the end of an actuator, not shown in FIG. 3, but provided behind the support shaft 206 as viewed in FIG. 3.

The cross sections 208 and 214 may be of some other geometric form having pairs of surfaces to cooperate with the cam followers.

Control of the stopper rod 200 is effected using the actuator to move the arm 220, support shaft 206, horizontal arm 204 and stopper rod 200, up and down, relative to the outlet of the tundish.

The sliding engagement between the support shaft 206 and the supporting framework 250 is affected in a completely different way from the prior art, however. The supporting frame 250 is provided with an upper set 260 and a lower set 262 of four cam followers 264. The cam followers 264 are configured so that one cam follower, in each of the upper and lower sets, engages each face of the square cross-section lengths 208, 214 of the support shaft 206. The cam followers 264 are provided with mountings on the support system 250 to allow their rotation during elevation or lowering of the support shaft 206. The rolling engagement provided by the cam followers 264, rather than the metal to metal sliding engagement provided in the prior art systems, is far smoother and offers a considerable reduction in friction. A reduction in friction level of approximately 5000% can be achieved using the present invention.

The use of eccentric cams 264 allows for the clearance between the cams 264 and the support shaft 206 to be adjusted, for instance to accommodate support shafts of different sizes or to accommodate variations due to changing operating conditions, such as temperature. Due to the limited contact surface between the cam followers 264 and the support shaft 206, not only is the frictional level reduced, but the effects of any misalignment or movement in the support shaft 206 and the support system 250 relative to one another are greatly reduced.

Due to their nature, the cam followers 264 are also readily interchanged or placed, when necessary, as they can be provided as a ready to mount item.

What is claimed is:

1. Apparatus for controlling the flow of material, such as molten metal, from a container, the apparatus comprising:

a first closing clement for the outlet from the container, a support system for the first element, an actuator system for moving the support system and first element, a fixed support frame for mounting the support system and first element, and a bearing system between the fixed support framework and the support system to facilitate movement of the support system relative to the fixed support framework, wherein the bearing system comprises a plurality contact surfaces between a component of the support framework and a component of the support system, at least one of the components providing a contact surface capable of rotation, wherein the bearing system is formed of:

a first set of opposing contact surfaces, each of the opposing contact surfaces including a contact surface capable of rotation contacting one of a pair of surfaces provided by a geometric form, the first set of opposing contact surfaces including a first contact surface capable of rotation which contacts a first surface provided by the geometric form and a second contact surface capable of rotation which contacts a second surface provided by the geometric form; and a second set of opposing contact surfaces, each of the opposing contact surfaces including a contact surface capable of rotation contacting one of another pair of surfaces provided by the geometric form, the second set of opposing contact surfaces including a first contact surface capable of rotation which contacts a third surface of the geometric form and a second contact surface capable of rotation which contacts a fourth surface provided by the geometric form;

the contact surfaces capable of rotation being provided by the fixed support framework or being provided by the support system, the geometric form providing the pairs of contact surfaces being provided by the other of the support system or the fixed support framework.

2. Apparatus according to claim 1 in which the bearing system facilitates reciprocating movement of the support system relative to the fixed support framework.

3. Apparatus according to claim 1 in which the contact surface capable of rotation is provided by the fixed support framework.

4. Apparatus according to claim 3 in which the rotatable contact surface is provided by a unit mounted on the fixed support framework, the unit comprising a mount for an axle which provides rotation facilitating retention of the rotatable contact surface.

5. Apparatus according to claim 1 in which the contact surface provided by the support system is a flat surface.

6. Apparatus according to claim 1 in which the first set of opposing contact surfaces and the second set of opposing contact surfaces contact two pairs of planar surfaces that are offset by an angle of 90 degrees relative to each other.

7. Apparatus according to claim 1 in which two or more such groups of contact surfaces are provided, at least one such set of contact surfaces are provided on an upper portion of the support system and at least one second set provided on a lower portion of the support system.

8. Apparatus according to claim 1 in which the first closing element comprises a stopper rod, and the stopper rod is provided on a substantial vertical axis within the container.

9. Apparatus according to claim 1 in which the support system comprises a laterally extending element and a substantially vertically aligned support shaft, with the support shaft received in the bearing system, the support shaft providing a mounting for the laterally extending element.

10. Apparatus according to claim 1 in which the support system includes one or more portions rotatably mounted relative to one another.

11. Apparatus according to claim 1 in which a support shaft, received in the bearing system is provided, two or more portions of the support shaft being adapted to rotate relative to one another.

12. Apparatus according to claim 1 in which the support system comprises an element linking the support shaft to an actuator system, the actuator system comprising a reciprocating mover.

13. Apparatus according to claim 12 in which the reciprocating mover is a hydraulic piston.

14. Apparatus according to claim 1 in which the fixed support framework mounts the support system, via the bearing system, on the container.

15. An apparatus for providing a controlled supply of molten metal, the apparatus comprising a container adapted to receive molten metal in use, the container having an outlet, the outlet cooperating with the closing element of a control apparatus according to claim 1.

16. Apparatus according to claim 1 in which the bearing system facilitates reciprocating movement of the support system relative to the fixed support framework, wherein the rotatable contact surface is provided by a unit mounted on the fixed support framework, the unit comprising a mount for an axle which provides rotation facilitating retention of the rotatable contact surface.

17. Apparatus according to claim 1 in which the first closing element comprises a stopper rod, and the stopper rod is provided on a substantial vertical axis within the container, wherein the support system further comprises:

a laterally extending element and a substantially vertically aligned support shaft, with the support shaft received in the bearing system, the support shaft providing a mounting for the laterally extending element, wherein one or more portions of the support shaft are rotatably mounted relative to one another; and an element linking the support shaft to an actuator system, the actuator system comprising a reciprocating mover.

18. Apparatus according to claim 1 in which the cross-section of the geometric form is other than a square cross-section.

19. Apparatus according to claim 1 in which the geometric form is of square cross-section.

20. Apparatus according to claim 1 in which the contact surfaces provided by the geometric form of the support system are flat surfaces.

21. Apparatus according to claim 1, wherein the.first set and second set of opposing contact surfaces provide rotational support to the support system in pairs of parallel planes that are parallel to the movement of the support system and not parallel to each other.

22. Apparatus according to claim 1, further comprising a second bearing system between the fixed support framework and the support system, wherein the second bearing system comprises:

a first set of opposing contact surfaces, each of the opposing contact surfaces including a contact surface capable of rotation contacting one of a pair of surfaces provided by a second geometric form, the first set of opposing contact surfaces including a first contact surface capable of rotation which contacts a first surface provided by the second geometric form and a second contact surface capable of rotation which contacts a second surface provided by the second geometric form; and a second set of opposing contact surfaces, each of the opposing contact surfaces including a contact surface capable of rotation contacting one of another pair of surfaces provided by the second geometric form, the second set of opposing contact surfaces including a first contact surface capable of rotation which contacts a third surface of the second geometric form and a second contact surface capable of rotation which contacts a fourth surface provided by the second geometric form.

23. A method for controlling the flow of molten metal from a container, the method comprising the steps of providing a volume of molten metal in the container, moving an actuator from a first position to a second position, the change in position of the actuator moving a support system relative to a fixed support framework by rotating a plurality of contact surfaces in a bearing system between the support system and the fixed support framework, the bearing system being formed of a first set of opposing contact surfaces, each of the opposing contact surfaces including a contact surface capable of rotation contacting one of a pair of surfaces provided by a geometric form, the first set of opposing contact surfaces including a first contact surface capable of rotation which contacts a first surface provided by the geometric form and a second contact surface capable of rotation which contacts a second surface provided by the geometric form and a second set of opposing contact surfaces, each of the opposing contact surfaces including a contact surface capable of rotation contacting one of another pair of surfaces provided by the geometric form, the second set of opposing contact surfaces including a first contact surface capable of rotation which contacts a third surface of the geometric form and a second contact surface capable of rotation which contacts a fourth surface provided by the geometric form, the contact surfaces of the bearing system being disposed between a component of the support system and a component of the fixed support framework, the contact surfaces capable of rotation being provided by the fixed support framework or being provided by the support system, the geometric form providing the pairs of contact surfaces being provided by the other of the support system or the fixed support framework, the movement of the support system moving a closing element for the outlet from the container, movement of the closing element away for the outlet facilitating flow of molten metal out of the outlet, movement of the closing element into contact with the outlet from the container preventing the flow of molten metal from the container.

* * * * *